US008177410B2

(12) United States Patent
Behr et al.

(10) Patent No.: US 8,177,410 B2
(45) **Date of Patent: *May 15, 2012**

(54) LAMP BASE AND LAMP

(75) Inventors: Gerhard Behr, Altheim (DE); Peter Helbig, Sontheim/Brenz (DE)

(73) Assignee: Osram AG, Munich (DE)

( * ) Notice: Subject to any disclaimer, the term of this patent is extended or adjusted under 35 U.S.C. 154(b) by 317 days.

This patent is subject to a terminal disclaimer.

(21) Appl. No.: 12/312,626

(22) PCT Filed: Dec. 6, 2007

(86) PCT No.: PCT/EP2007/063451

§ 371 (c)(1),
(2), (4) Date: May 19, 2009

(87) PCT Pub. No.: WO2008/074648

PCT Pub. Date: Jun. 26, 2008

(65) Prior Publication Data

US 2009/0257236 A1 Oct. 15, 2009

(30) Foreign Application Priority Data

Dec. 19, 2006 (DE) ..... 10 2006 060 026

(51) Int. Cl.
*H01R 33/00* (2006.01)

(52) U.S. Cl. ..... 362/652; 362/549; 362/647

(58) Field of Classification Search ..... 362/549, 362/647, 652, 656–659; 313/318.01, 318.05, 313/318.06

See application file for complete search history.

(56) References Cited

U.S. PATENT DOCUMENTS

| | | | | |
|---|---|---|---|---|
| 5,479,066 | A * | 12/1995 | Willems et al. | 313/318.05 |
| 5,760,537 | A * | 6/1998 | Friederichs | 313/318.03 |
| 7,712,938 | B2 | 5/2010 | Behr et al. | |

FOREIGN PATENT DOCUMENTS

| | | | |
|---|---|---|---|
| DE | 20 2006 002 888 | U1 | 5/2006 |
| DE | 20 2006 002 889 | U1 | 5/2006 |
| DE | 20 2006 009 052 | U1 | 8/2006 |

* cited by examiner

*Primary Examiner* — Thomas Sember

(74) *Attorney, Agent, or Firm* — Holtz, Holts, Goodman & Chick, PC

(57) ABSTRACT

The invention relates to a lamp base comprising a plastic base part (320) that is provided with electric connections (61, 62, 63) for supplying power to at least one luminous means (21, 22) of the lamp that is surrounded by the lamp vessel (10). The electric connections (61, 62, 63) comprise contact sections (610, 620, 630) for connecting to power supply lines (51, 52, 53) of the at least one luminous means (21, 22), that protrude from the lamp vessel (10), and the lamp base is equipped with a sealing element (330) for covering the contact sections (610, 620, 630), said sealing element being fixed to the plastic base part (320) by a detent connection (3213, 3223, 3311, 3312, 3321, 3322). Said detent connection is preferably concealed. Said lamp base can be used, for example, in a motor vehicle headlight.

13 Claims, 4 Drawing Sheets

LAMP BASE AND LAMP

Figure 1:
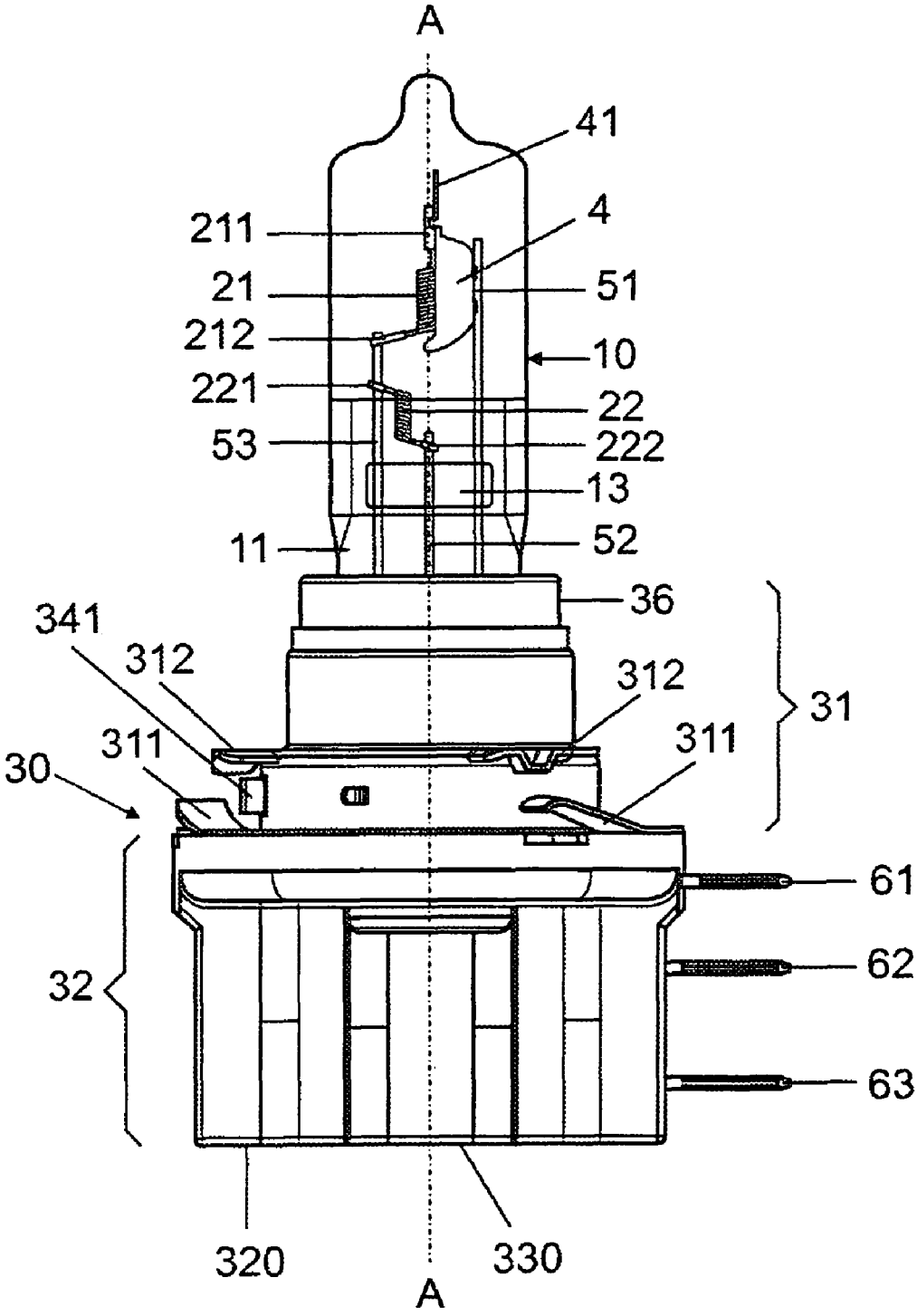

This application is a U.S. National Phase Application under 35 USC 371 of International Application PCT/EP2007/063451, filed Dec. 6, 2007, which is incorporated herein in its entirety by this reference.

The invention relates to a lamp base in accordance with the preamble of claim 1, and a lamp having such a lamp base.

I. PRIOR ART

Such a lamp base is disclosed, for example, in German utility model DE 20 2006 002 888 U1. This utility model describes a lamp base having a plastic base part that is provided with three electrical connections for supplying power to the two incandescent filaments, surrounded by a lamp vessel, of the lamp, the electrical connections having contact portions that are respectively provided for connection to supply lead wire, projecting from the lamp vessel, for the two incandescent filaments. The lamp base is equipped with a closure element for covering the contact elements. The closure element is fixed on the plastic base part by means of a clamping fit. To this end, the closure element has a pin that is introduced into an accurately fitting cutout in the plastic base part.

II. SUMMARY OF THE INVENTION

It is an object of the invention to ensure an improved fixing of the closure element on the plastic base part.

This object is achieved according to the invention by the features of claim 1. Particularly advantageous designs of the invention are described in the dependent claims.

The inventive lamp base has a plastic base part that is provided with electrical connections for supplying power to at least one luminous means, surrounded by a lamp vessel, of the lamp, the electrical connections having contact portions that are provided for connection to supply leads, projecting from the lamp vessel, of the at least one luminous means, and the lamp base being equipped with a closure element for covering the contact elements, which closure element is fixed on the plastic base part by a detent connection. A reliable connection between the two above-named lamp base parts is ensured by the detent connection between the closure element and the plastic base part, since after the latching of the detent connection the closure element can no longer be removed from the plastic base part. By contrast with the clamping fit in accordance with the prior art, the detent connection prevents the closure element from being taken off the plastic base part.

The detent connection between the plastic base part and the closure element is preferably designed in such a way that it is not visible in the latched state of the closure element and plastic base part, in order to avoid attempts being made to open the detent closure.

The plastic base part advantageously has a cutout for holding the closure element, in order to enable the closure element to be anchored securely on the plastic base part.

The plastic base part is preferably equipped in the region of the above-named cutout with first guide means, and the closure element has second guide means that are coordinated with the first guide means in order to simplify the insertion of the closure element into the cutout.

In accordance with the preferred exemplary embodiment of the invention, the detent connection is arranged in the region of the above-named guide means.

In order to be able to attain the detent connection in the simplest possible way, in order to form the detent connection the first or second guide means are provided with resiliently designed detent noses that are coordinated with accurately fitting recesses in the second or first guide means.

The first guide webs, arranged on the plastic base part, and the second guide webs, arranged on the closure element, are designed in accordance with the preferred exemplary embodiment as interlocking guide webs, in order to ensure a reliable guidance of the closure element when it is mounted on the plastic base part.

The plastic base part and the closure element of the inventive lamp base advantageously form an interior space in which the contact portions of the electrical connections are arranged. Before the closure element is mounted, it is possible for supply leads projecting from the lamp vessel to be connected, that is to say welded or soldered, in this interior space to the contact portions of the electrical connections. The mounting of the closure element covers this interior space such that the connections between the supply lead wires and the electrical connections are inaccessible from outside.

In accordance with the preferred exemplary embodiment of the invention, the detent connection between the plastic base part and the closure element is concealed by a wall region of the closure element or of the plastic base part. Consequently, it is possible in the latched state for the invisibility of the detent connection to be achieved from outside in a simple way.

The inventive lamp base is preferably used in vehicle lamps, for example in halogen incandescent lamps for a motor vehicle headlight.

III. DESCRIPTION OF THE PREFERRED EXEMPLARY EMBODIMENT

Figure 2:
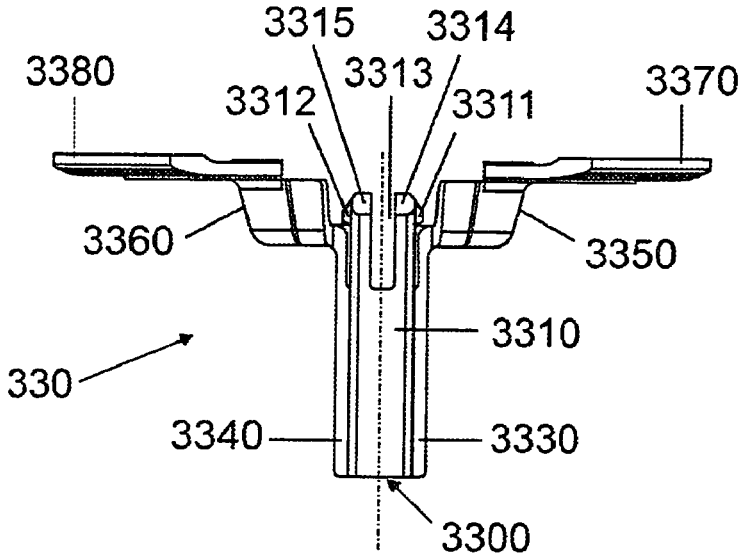
Figure 3:
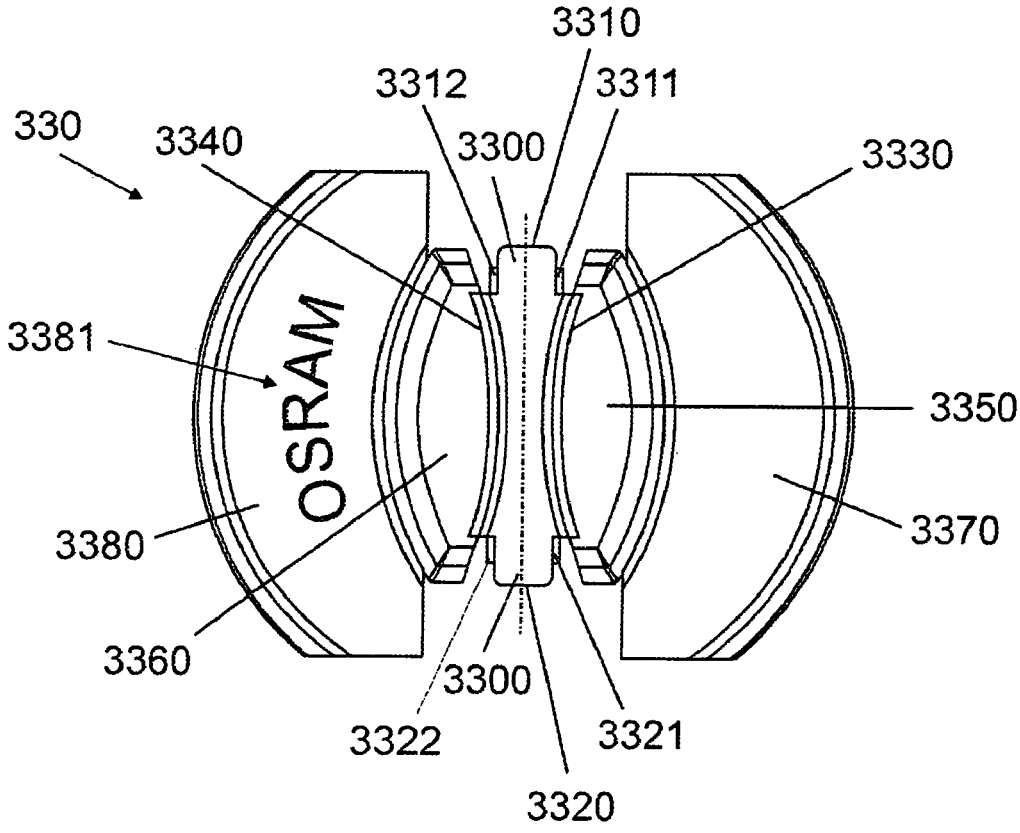
Figure 4:
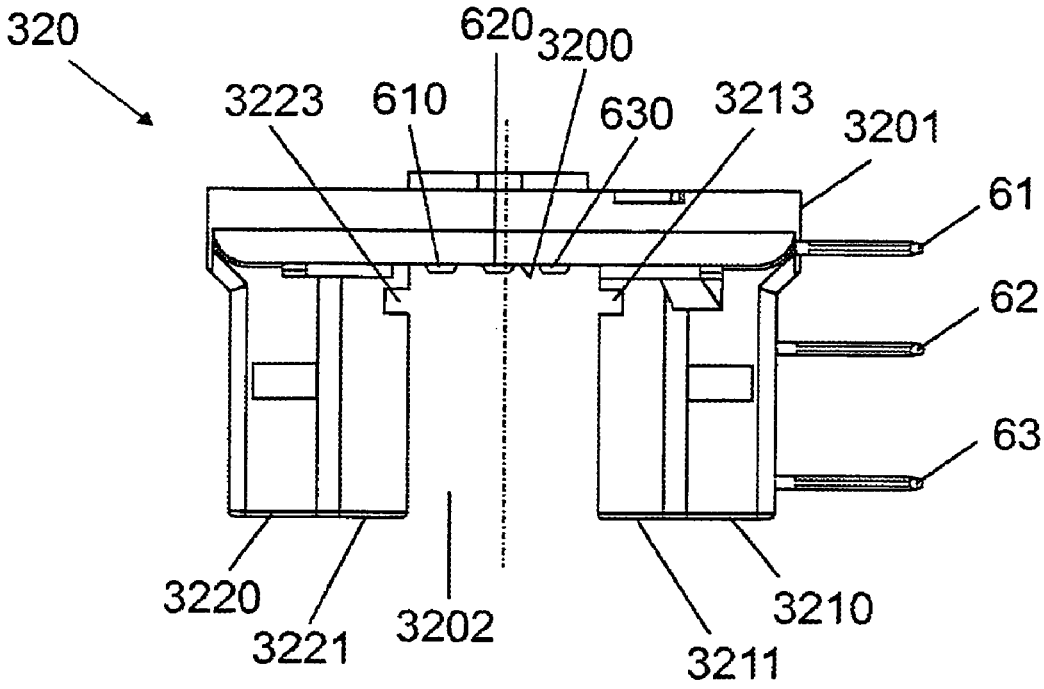
Figure 5:
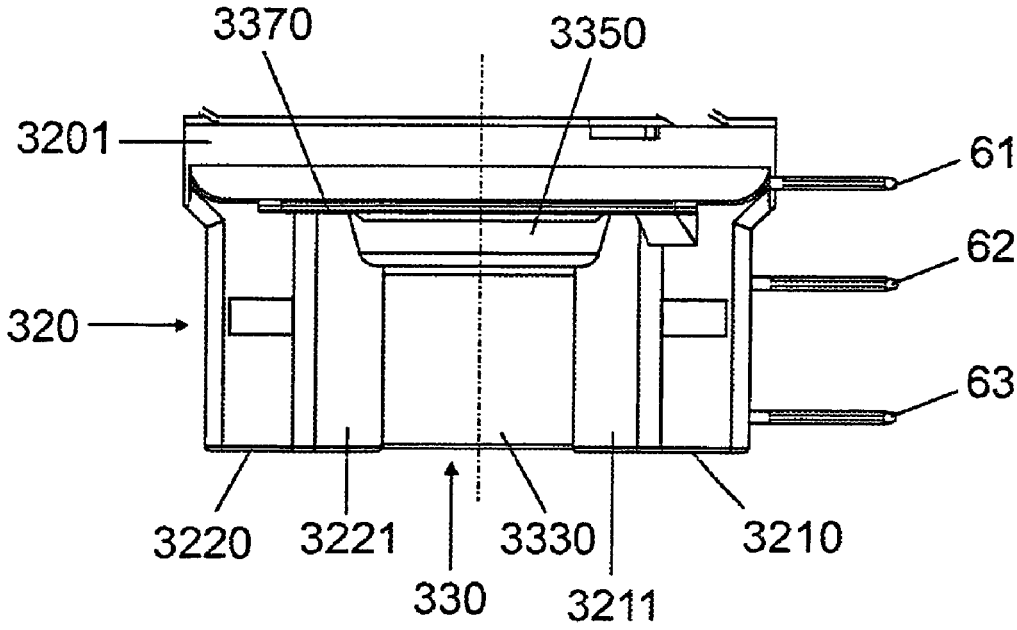
Figure 6:
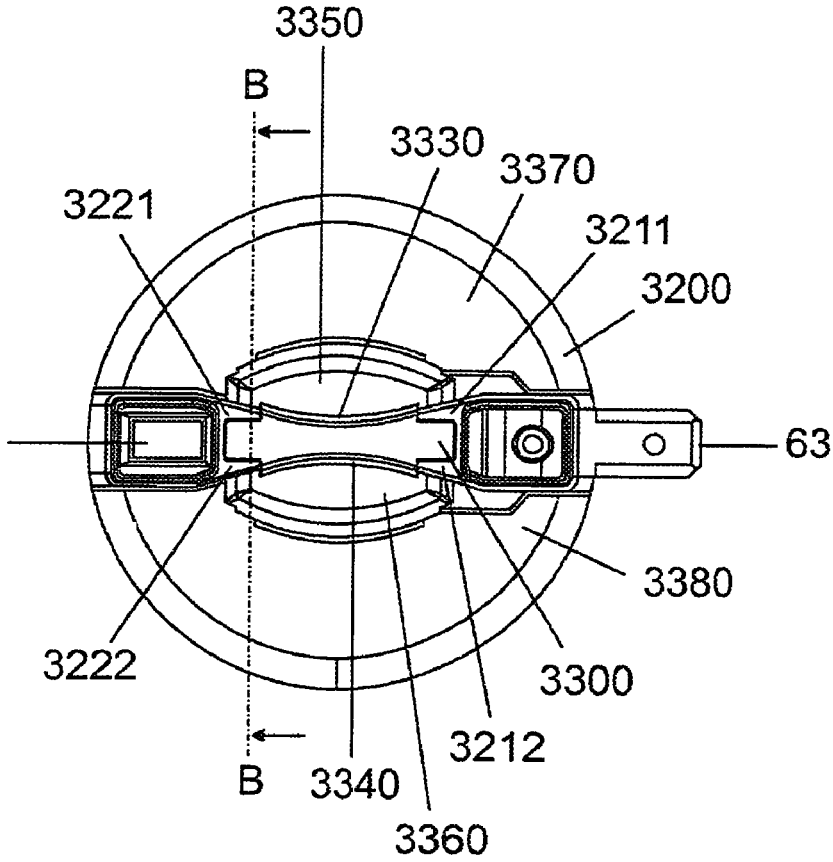
Figure 7:
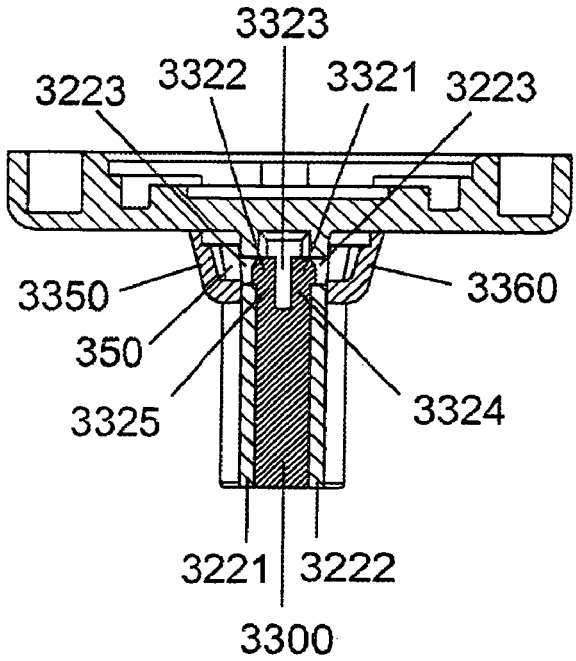

The invention is explained in more detail below with the aid of a preferred exemplary embodiment. In the drawing:

FIG. 1 shows a side view of a lamp and of a lamp base in accordance with the preferred exemplary embodiment of the invention, FIG. 2 shows a side view of the closure element of the lamp base of the lamp illustrated in FIG. 1, in a view rotated by comparison with FIG. 1 by an angle of 90 degrees about the longitudinal axis of the lamp, FIG. 3 shows a plan view of the underside of the closure element illustrated in FIG. 2, FIG. 4 shows a side view of the plastic base part of the lamp base of the lamp illustrated in FIG. 1, FIG. 5 shows a side view of the plastic base part and of the closure element of the lamp base illustrated in FIG. 1, in the mounted state of the plastic base part and closure element, FIG. 6 shows a plan view of the end, averted from the lamp vessel, of the lamp illustrated in FIG. 1, and of the underside of the plastic base part, illustrated in FIG. 5, including the closure element, and FIG. 7 shows a cross section through the plastic base part, illustrated in FIGS. 5 and 6, and through the closure. element along the section B-B.

FIG. 1 illustrates an inventive halogen incandescent lamp for a vehicle headlight. This halogen incandescent lamp has a vitreous, substantially cylindrical lamp vessel 10 in whose interior space are arranged two incandescent filaments 21, 22 that are aligned parallel to the lamp vessel axis and serve to generate a high beam and a daytime running light. The incandescent filaments 21, 22 are designed as singly helically wound tungsten wires. The filament outline feeders 211, 212 and 221, 222 of the incandescent filaments 21 and 22, respectively, are wound around in each case by a molybdenum foil that serves as a welding aid during welding of the filament outline feeders 211, 212 and 221, 222 respectively, to supply leads for the incandescent filaments 21, 22. A sealed end 11 of the lamp vessel 10 is anchored in a lamp base 30. The first incandescent filament 21 is partially surrounded by an anti-dazzle device 4 formed from a molybdenum sheet. The anti-dazzle device 4 is supported by a first supply lead wire 51 that, together with a second 52 and third supply lead wire 53, serves for supplying power to the two incandescent filaments 21, 22. To this end, a first filament outgoing feeder 211 of the first incandescent filament 21 is welded by projection welding to a welding lug 41 of the anti-dazzle device 4, and thereby connected in an electrically conducting fashion to the first supply lead wire 51 via the anti-dazzle device 4. The second filament outgoing feeder 212 of the first incandescent filament 21 is welded to the third supply lead wire 53. The first filament outgoing feeder 221 of the second incandescent filament 22 is likewise welded to the third supply lead wire 53. The second filament outgoing feeder 222 of the second incandescent filament 22 is welded to the second supply lead wire 52. The three supply lead wires 51, 52, 53 respectively consist of molybdenum and are fixed between two quartz glass webs 13 fused to one another, with the result that they are arranged in a common plane. The three supply lead wires 51, 52, 53 are guided through the sealed end 11 of the lamp vessel 10 and connected in an electrically conductive fashion in each case to one of the three contact lugs 61, 62 or 63. The three contact lugs 61, 62, 63 project laterally from the lamp base 30 and form the electrical connections of the halogen incandescent lamp. The lamp base 30 is designed as a metal/plastic base that has both a metal base portion 31 and a base portion 32 consisting of plastic. The lamp vessel 10 is anchored in the metal base portion 31, and the base portion 32 consisting of plastic is provided with the electrical contacts 61, 62, 63 of the lamp. A metal spring ring with three spring tabs 311 and three key tabs 312 serve to mount the halogen incandescent lamp in the headlight reflector. The rim of the mounting opening of the reflector is arranged in the headlight in a clamping fashion between the spring tabs 311 and the key tabs 312 once the lamp has been mounted. A leaf spring 341 serves to fix the lamp laterally in the mounting opening of the headlight reflector. It acts in a fashion perpendicular to the longitudinal extent of the lamp.

The base portion 32 consisting of plastic comprises the plastic base part 320, illustrated in FIG. 4, which is equipped with the electrical connections 61, 62, 63 and the closure element 330 which likewise consists of plastic and is illustrated in FIGS. 2 and 3.

The plastic base part 320 has a portion 3201 shaped as a circular disk, and two mutually opposite webs 3210, 3220 that are integrally formed on the underside, averted from the lamp vessel 10, of the portion 3201 and extend parallel to the axis of the portion 3201 shaped as a circular disk and to the longitudinal axis A-A of the lamp. The three contact lugs 61, 62, 63 respectively consist of a metal sheet and are embedded in the first web 3210 such that their free ends project laterally or radially from the web 3210 of the plastic base part 320 and are arranged one above another in the direction of the lamp longitudinal axis. The ends 610, 620, 630, welded to the supply lead wires 51, 52, 53, of the contact lugs 61, 62, 63 are arranged close to the axis of the portion 3201 shaped as a circular disk, in a cutout 3202 on its underside 3200, that is to say on the side 3200, averted from the lamp vessel 10, of the portion 3201 shaped as a circular disk. The ends 610, 620, 630, to be welded to the supply lead wires 51, 52, 53, of the contact lugs 61, 62, 63 in each case have a perforation through which the corresponding supply lead wire 51, 52 and 53, respectively, is guided and on which the underside, averted from the lamp vessel 10, of the contact lug 61, 62 and 63 respectively, is welded to the end 610, 620 and 630, respectively, of this contact lug 61, 62, 63. The two webs 3210, 3220 respectively have on their side facing the cutout 3202 two guide rails 3211, 3212 and 3221, 3222, respectively, that serve for guiding the closure element 321 to be inserted into the cutout 3202. The guide rails 3211, 3212 of the first web 3210 are respectively provided with a recess 3213 at their end facing the underside 3200 of the portion 3201 shaped as a circular disk. In a way similar to this, the guide rails 3221, 3222 of the second web 3220 have a recess 3223 at their end facing the underside 3200 of the portion 3201 shaped as a circular disk. These recesses 3213, 3223 enable a detent connection with the aid of detent noses 3311, 3312, 3321, 3322 that are arranged on the closure element 330 and latch in recesses 3213, 3223 when the closure element 330 is introduced into the cutout 3202.

Details of the closure element 330 are illustrated in FIGS. 2 and 3. The closure element 330 has a web-like portion 3300 with two mutually opposite narrow end faces 3310, 3320 and two, likewise mutually opposite, concavely cambered broad sides 3330, 3340. A portion 3350 and 3360, 3370 and respectively, shaped as a half shell is integrally formed on the outsides 3330 and 3340 respectively, at the upper end of the web-like portion 3300. A wing-like portion plane 3380, respectively, of the closure element 330 in each case adjoins these portions 3350 and 3360 respectively, shaped as half shells. The wing-like portions 3370, 3380 are of flat, virtually plane design and serve chiefly to offer a sufficient surface for an inscription 3381, for example by means of a laser. At their ends, the two narrow end faces 3310 and 3320, respectively, in each case have two spring tabs 3314 and 3315 or 3324 and 3325 that are separated from one another by a slot 3313 and 3323, respectively, and each of which is equipped with a detent nose 3311, 3312, 3321, 3322. The detent noses 3311, 3312, 3321, 3322 are arranged in each case on the side of the spring tabs 3314, 3315, 3324, 3325 averted from the slot 3313 and 3323, respectively.

When the closure element 330 is introduced into the cutout 3202 of the plastic base part 320, the narrow end faces 3310 and 3320, respectively, of the closure element 330 engage in the interspace between the guide rails 3211 and 3212 or 3221 and 3222 on the webs 3210 and 3220, respectively, of the plastic base part. In this case, the spring tabs 3314 and 3315 or 3324 and 3325 are firstly pressed together such that the slot 3313 and 3323, respectively, is constricted between them. As soon as the detent noses 3311, 3312 and 3321, 3322, respectively, arranged on the spring tabs 3314 and 3315 or 3324 and 3325 have reached the position of the recesses 3213 and 3223, respectively, upon insertion of the closure element 330 into the cutout 3202, the detent noses 3311, 3312 and 3321, 3322, respectively, latch in these recesses 3213 and 3223, respectively, as a result of which an undisconnectable detent closure is produced between the plastic base part 320 and the closure element 330. This detent connection can best be seen in FIGS. 5, 6 and 7. After the latching of the detent closure, the top sides of the wing-like portions 3370 and 3380, respectively, bear against their underside 3200 of the portion 3201, shaped like a circular disk, of the plastic base part 320. The portions 3350 and 3360, shaped as half shells, of the closure element 330 in this case cover the contact portions 610, 620, 630, arranged on the underside 3200 of the portion 3201 shaped as a circular disk, of the electrical connections 61, 62, 63. The interspaces between the two portions 3350, 3360, shaped as half shells, in the region of the end faces 3310, 3320 are closed off in this case by the webs 3210, 3220 such that the portions 3350, 3360, shaped as half-shells, of the closure element 330, and the webs 3210, 3220 as well as the underside 3200 of the plastic base part 320 form an encapsulated interior space 350 for the contact portions 610, 620, 630 of the electrical connections 61, 62, 63. After the mounting of the closure element 330 on the plastic base part 320, the detent noses 3311, 3312, 3321, 3322 and the recesses 3213, 3223 for the detent noses are covered by the portions 3350, 3360, shaped as half shells, of the closure element 330 such that the detent connection is not visible from outside. The closure element 330 fills up the interspace between the mutually opposite webs 3210, 3220 and forms therewith a grip for inserting the lamp into a corresponding mounting opening in a vehicle headlight. In order to obtain a coding for different, mutually compatible versions of the same type of vehicle headlamps that can be interchanged for one another in the vehicle headlight, the closure element 330 preferably consists of a colored plastic, the closure elements 330 being fabricated from variously colored plastics for different lamp versions.

The closure element 330 consists, for example, of polyamide or polybutylene terephthalate, while the plastic base part 320 arranged nearer the lamp vessel 10 consists of plastic capable of higher thermal loading, for example of polyphenylsulfide. The plastic base part 320 and the closure element 330 are designed in each case, for example, as a plastic injection molded part. The closure element 330 can be used to color code the lamp by equipping different variously colored closure elements 330 in order to identify the type.

The invention is not limited to the exemplary embodiment described in more detail above, but can also be applied to other lamp types.

The invention claimed is:

1. A lamp base having a plastic base part that is provided with electrical connections for supplying power to at least one luminous means, surrounded by a lamp vessel, of the lamp, the electrical connections having contact portions that are provided for connection to supply leads, projecting from the lamp vessel, of the at least one luminous means, and the lamp base being equipped with a closure element for covering the contact portions wherein the closure element is fixed on the plastic base part by a detent connection as a result of which an undisconnectable detent closure is produced between the plastic part and the closure element.

2. The lamp base as claimed in claim 1, in which the detent connection is designed in such a way that it is not visible in a latched state of the closure element and plastic base part.

3. The lamp base as claimed in claim 1 or 2, in which the plastic base part has a cutout for holding the closure element.

4. The lamp base as claimed in claim 3, in which the plastic base part is provided in the region of the cutout with first guide means, and the closure element is provided with second guide means that are coordinated with the first guide means.

5. The lamp base as claimed in claim 4, in which the detent connection is arranged in the region of the guide means.

6. The lamp base as claimed in claim 4, in which in order to form the detent connection the first or second guide means are provided with resiliently designed detent noses that are coordinated with accurately fitting recesses in the second or first guide means.

7. The lamp base as claimed in claim 6, in which the first and second guide means are designed as interlocking guide webs.

8. The lamp base as claimed in claim 7, in which the plastic base part and the closure element form an interior space in which the contact portions of the electrical connections are arranged.

9. The lamp base as claimed in claim 8, in which in a latched state of the plastic base part and closure element the detent connection is concealed by a wall region of the closure element or of the plastic base part.

10. The lamp base as claimed in claim 3, in which the first and second guide means are designed as interlocking guide webs.

11. The lamp base as claimed in claim 1, in which the plastic base part and the closure element form an interior space in which the contact portions of the electrical connections are arranged.

12. The lamp base as claimed in claim 1, in which in a latched state of the plastic base part and closure element the detent connection is concealed by a wall region of the closure element or of the plastic base part.

13. A lamp having a lamp base as claimed in claim 1.

* * * * *